US007165796B1

(12) United States Patent
Hung

(10) Patent No.: US 7,165,796 B1
(45) Date of Patent: Jan. 23, 2007

(54) GOLF BALL PICK-UP DEVICE

(76) Inventor: Shao-Fu Hung, No. 204, Sha-Tien Rd., Sha-Lu Chen, Taichung Hsien (TW)

( * ) Notice: Subject to any disclaimer, the term of this patent is extended or adjusted under 35 U.S.C. 154(b) by 0 days.

(21) Appl. No.: 11/379,050

(22) Filed: Apr. 17, 2006

(51) Int. Cl.
*A63B 47/02* (2006.01)

(52) U.S. Cl. ..... 294/19.2

(58) Field of Classification Search ..... 294/19.2; 473/286, 517; 56/328.1, 332; 206/315.9
See application file for complete search history.

(56) References Cited

U.S. PATENT DOCUMENTS 2,203,170 A * 6/1940 MacDonald ..... 294/19.2
3,117,814 A * 1/1964 Webb ..... 294/19.2
3,901,545 A * 8/1975 Shott ..... 294/19.2
4,088,251 A * 5/1978 Rodriguez ..... 224/626
4,629,235 A * 12/1986 Logue ..... 294/19.2
5,639,133 A * 6/1997 Mote ..... 294/19.2
5,810,681 A * 9/1998 Heim ..... 473/496
6,572,167 B2 * 6/2003 Deininger ..... 294/19.2

* cited by examiner

*Primary Examiner*—Dean J. Kramer
(74) *Attorney, Agent, or Firm*—Squire, Sanders & Dempsey

(57) ABSTRACT

A golf ball pick-up device includes an upright pick-up tube having an upper end portion formed with a ball-exiting opening. A strip unit includes plurality of resilient strips extending radially and inwardly from an open lower end of the pick-up tube so as to define a ball inlet thereamong. The strips deform so as to allow golf balls to move into the pick-up tube via the ball inlet when the strip unit is pressed against the golf balls one at a time, and is sized so as to prevent downward removal of the golf balls from the pick-up tube via the ball inlet. A ball-guiding unit is disposed within the upper end portion of the pick-up tube, and is formed with a ball-guiding surface shaped so as to guide the golf balls into the ball-exiting opening when the golf balls move upwardly within the pick-up tube.

12 Claims, 12 Drawing Sheets

GOLF BALL PICK-UP DEVICE

BACKGROUND OF THE INVENTION

1. Field of the Invention

This invention relates to a device for use with golf balls, and more particularly to a golf ball pick-up device.

2. Description of the Related Art

Referring to FIGS. 1 and 2, a conventional golf ball pick-up device 10 includes a rectangular hollow box 12 having an upper end opening 11, a bottom wall 121 formed with a circular bottom opening 13, and four lateral side walls 122 each formed with a circular side opening 14. The conventional golf ball pick-up device 10 further includes an upright handle rod 15 mounted vertically and movably on the box 12. During use, five golf balls 20 can be plugged respectively into the bottom opening 13 and the side openings 14, as shown in FIG. 2.

The aforesaid conventional golf ball pick-up device 10 suffers from the following disadvantages:

(1) To engage a golf ball with one of the side openings 14 in the box 12, the user needs to squat down so as to place the rod 15 in a generally horizontal position, thereby resulting in inconvenient use.

(2) After the golf balls are picked up and retained on the golf ball pick-up device 10, it is necessary to take the golf balls out of the box 12 and put the same into a collecting unit, such as a bag, one at a time. This affects adversely the ball pick-up efficiency.

SUMMARY OF THE INVENTION

The object of this invention is to provide a highly efficient golf ball pick-up device that is convenient to use.

According to this invention, a golf ball pick-up device includes an upright pick-up tube having an upper end portion formed with a ball-exiting opening. A strip unit includes plurality of resilient strips extending radially and inwardly from an open lower end of the pick-up tube so as to define a ball inlet thereamong. The strips deform so as to allow golf balls to move into the pick-up tube via the ball inlet when the strip unit is pressed against the golf balls one at a time, and is sized so as to prevent downward removal of the golf balls from the pick-up tube via the ball inlet. A ball-guiding unit is disposed within the upper end portion of the pick-up tube, and is formed with a ball-guiding surface shaped so as to guide the golf balls into the ball-exiting opening when the golf balls move upwardly within the pick-up tube.

As such, the golf balls can be picked up without the need for the user to squat down, thereby resulting in convenient use. Furthermore, the golf balls can be moved automatically into a collecting unit via the ball-exiting opening. This increases the ball pick-up efficiency since the user need not discontinue picking up golf balls and manually place the golf balls into the collecting unit.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
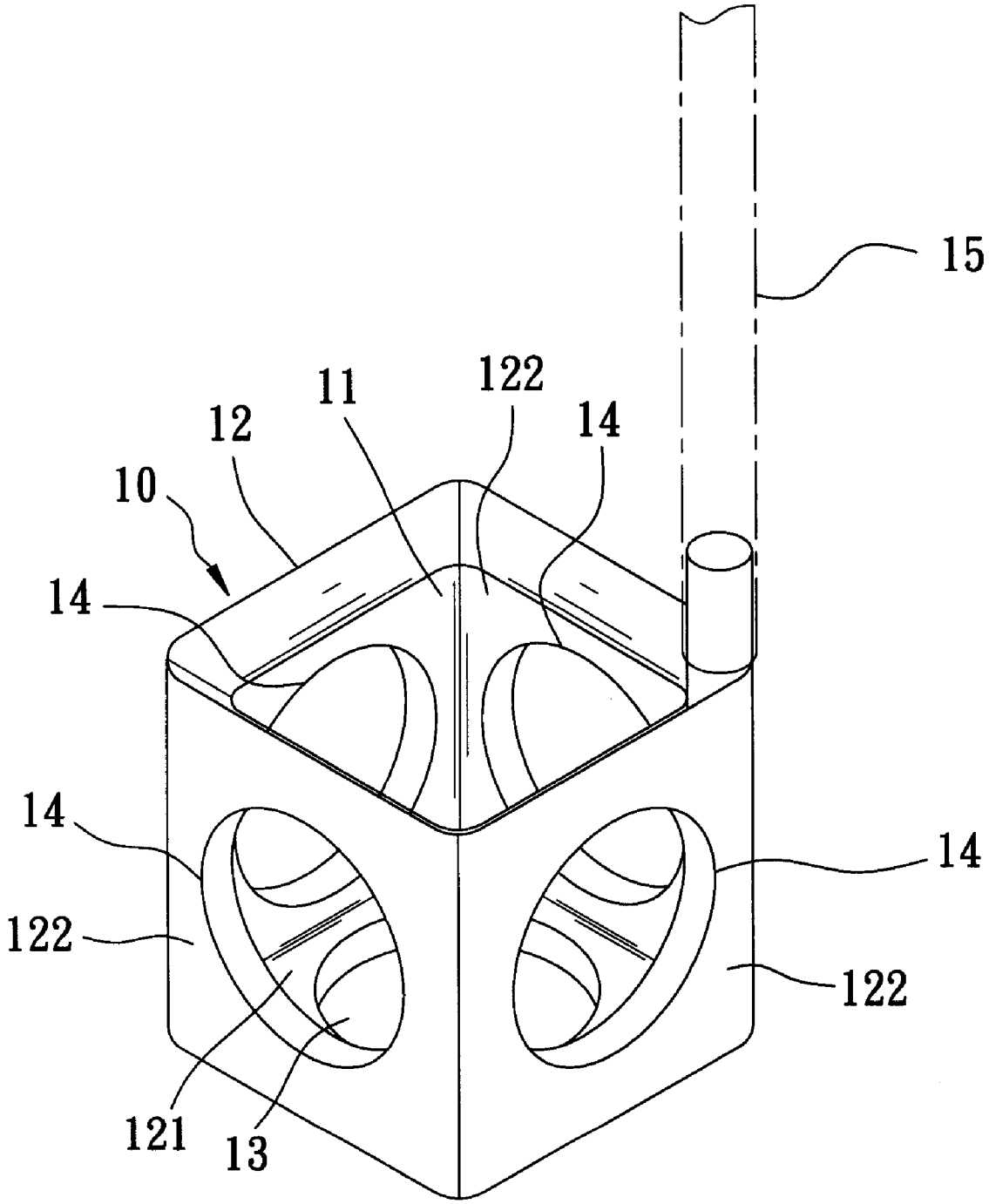
FIG. 1 PRIOR ART
FIG. 1 is a perspective view of a conventional golf ball pick-up device.
Figure 2:
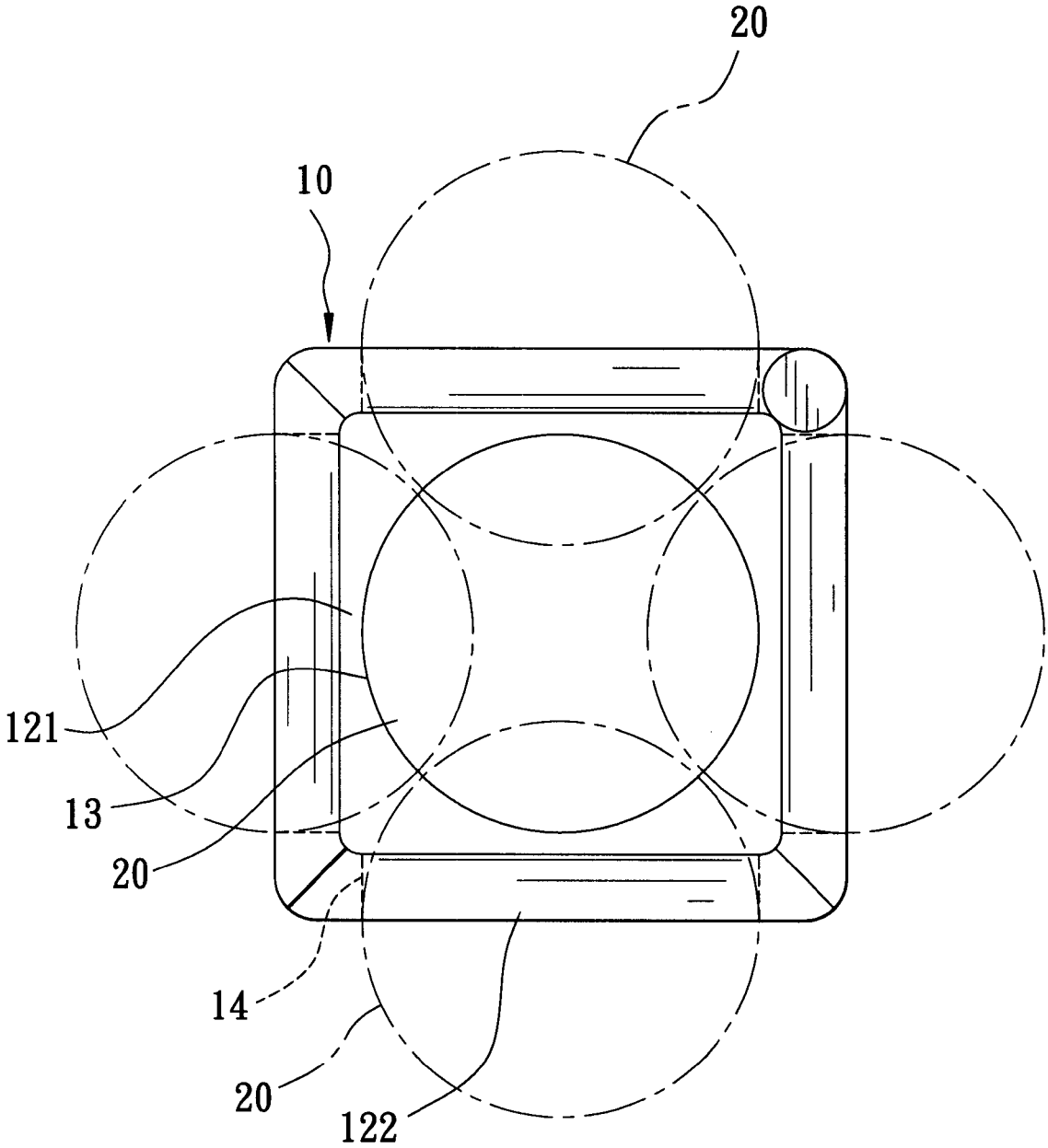
FIG. 2 PRIOR ART
FIG. 2 is a schematic view of the conventional golf ball pick-up device, illustrating how a plurality of golf balls are retained on the conventional golf ball pick-up device.

Before the present invention is described in greater detail in connection with the preferred embodiments, it should be noted that similar elements and structures are designated by like reference numerals throughout the entire disclosure.

Figure 3:
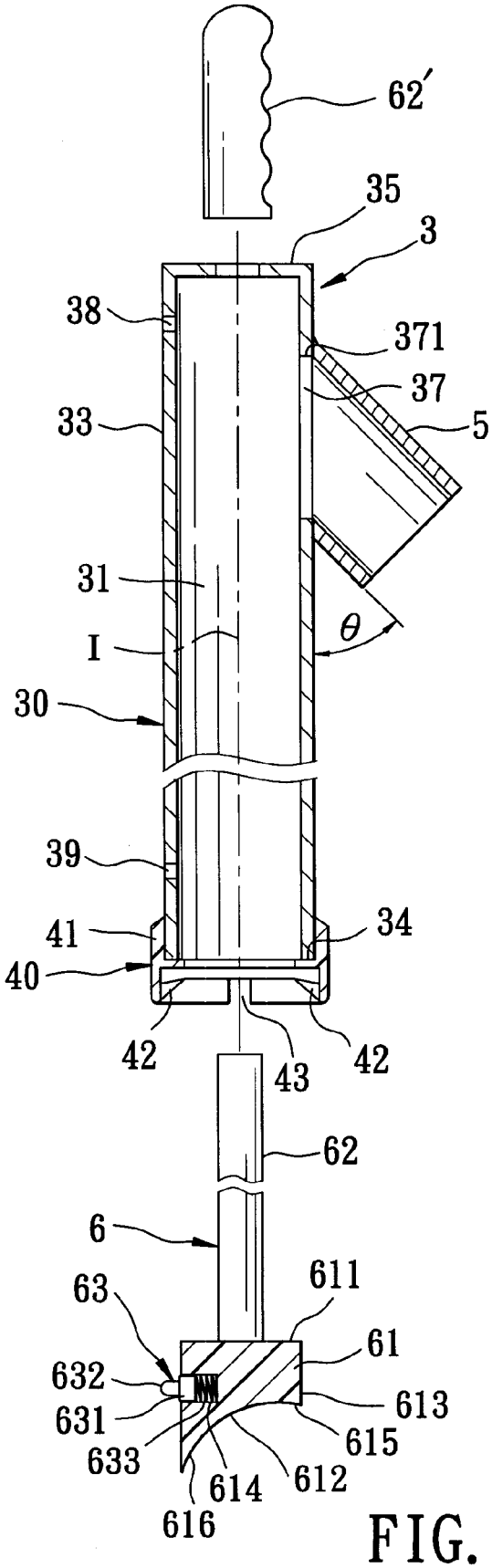
FIG. 3 is a partly exploded, partly sectional view of the first preferred embodiment of a golf ball pick-up device according to this invention.
Figure 4:
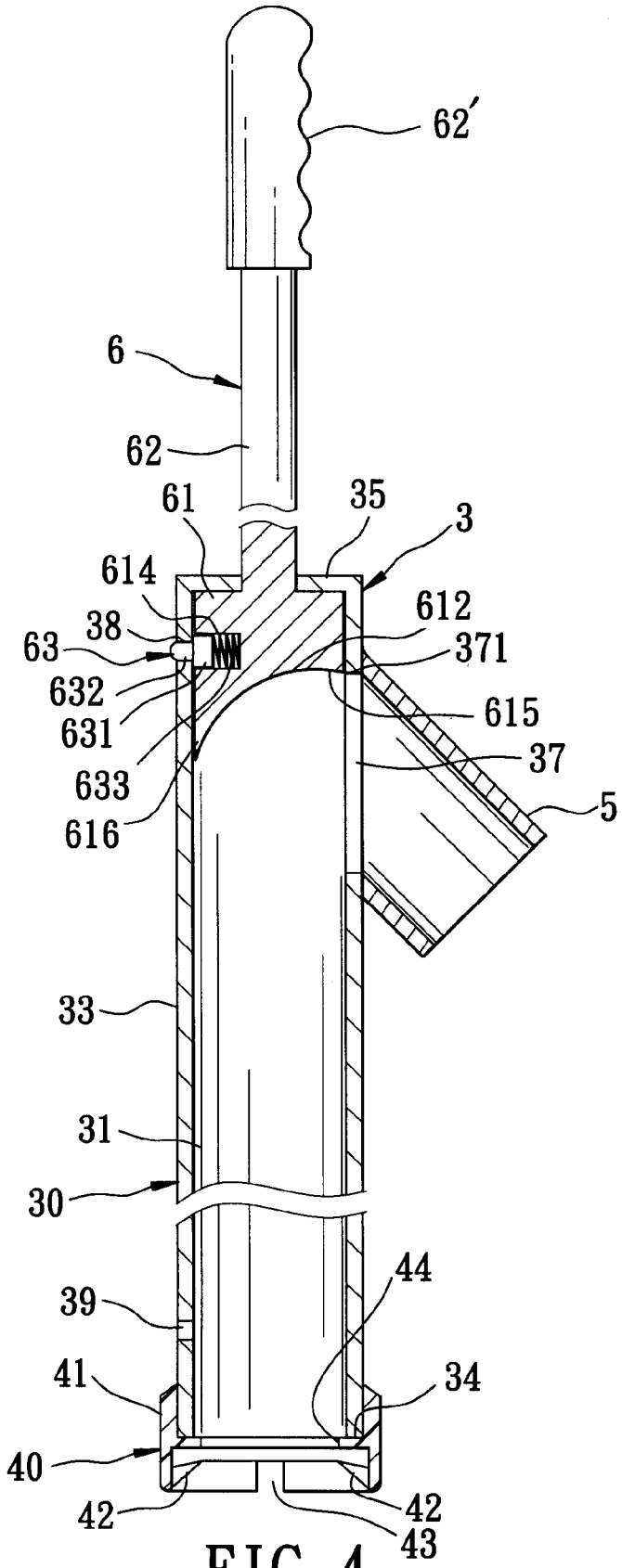
FIG. 4 is a partly sectional view of the first preferred embodiment when a handle is disposed in an extended position.
Figure 5:
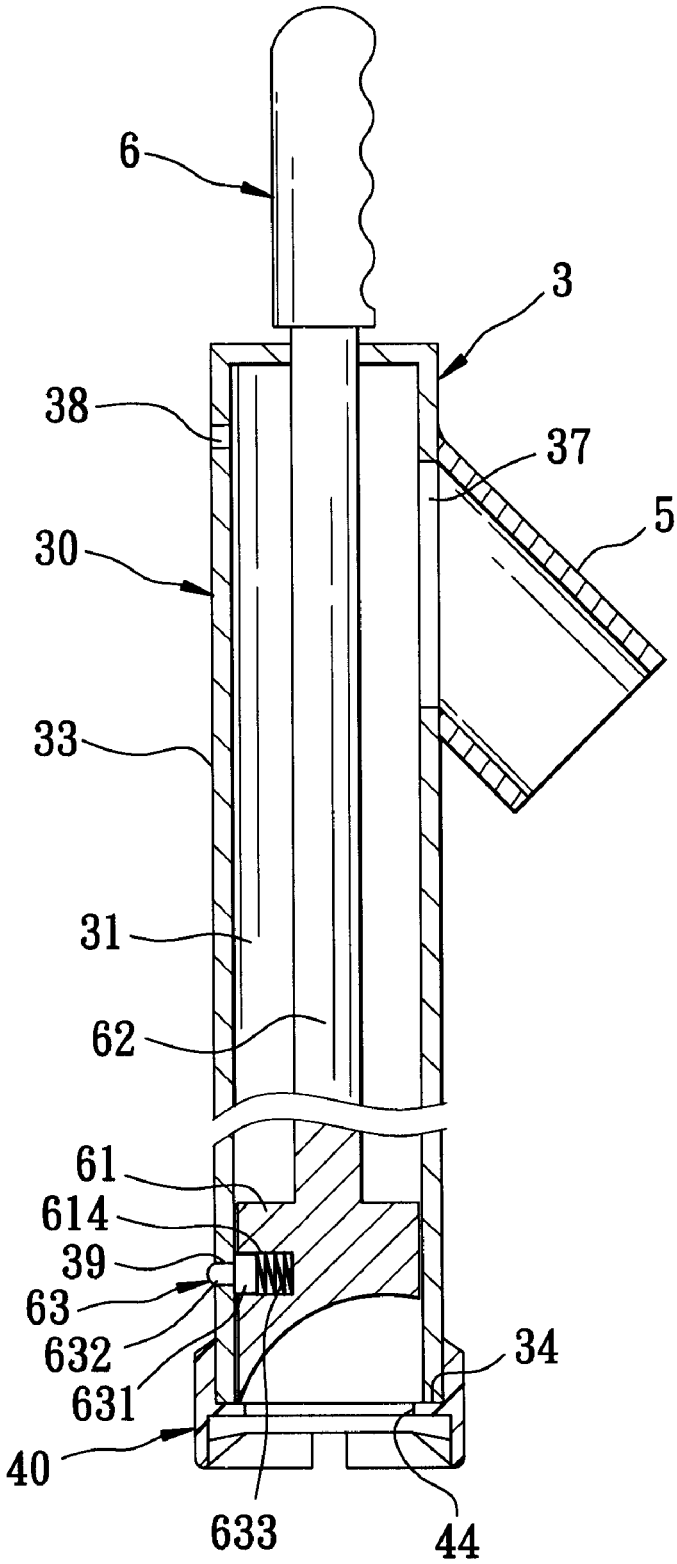
FIG. 5 is a partly sectional view of the first preferred embodiment when the handle is disposed in a retracted position.

Referring to FIGS. 3 and 4, the first preferred embodiment of a golf ball pick-up device 3 according to this invention includes an upright pick-up tube 30, a sleeve member 40, an inclined ball-exiting tube 5, and an upright handle 6.

The pick-up tube 30 defines a ball-receiving space 31, and has an annular surrounding wall 33, an open lower end 34, an upper end wall 35, an upper end portion formed with a circular ball-exiting opening 37, an upper positioning hole 38, and a lower positioning hole 39. The ball-receiving space 31 has a diameter slightly greater than that of standardized golf balls 7 (see FIG. 7). The surrounding wall 33 is disposed around an axis (I). The ball-exiting opening 37 is defined by an opening-defining wall 371, and has a diameter slightly greater than that of the golf balls 7 (see FIG. 7).

The sleeve member 40 includes a sleeve body 41 sleeved fixedly on the open lower end 34 of the pick-up tube 30, and a strip unit consisting of a plurality of resilient strips 42. The sleeve body 41 is formed with an inward flange 44 extending radially and inwardly therefrom and abutting against the open lower end 34 of the pick-up tube 30. Each of the strips 42 has a radial outer end formed integrally with a lower end of the sleeve body 41. The strips 42 are arranged along a circumferential direction of the pick-up tube 30, and extend radially and inwardly from the sleeve body 41 so as to define a ball inlet 43 thereamong. When the strip unit is pressed against the golf balls 7 (see FIG. 7) one at a time, the strips 42 deform so as to allow the golf balls 7 to move into the pick-up tube 30 via the ball inlet 43. The strips 42 are sized so as to prevent downward removal of the golf balls 7 (see FIG. 7) from the pick-up tube 30 via the ball inlet 43 (see FIG. 7).

The ball-exiting tube 5 is connected fixedly to and extends outwardly and downwardly from the pick-up tube 30, such that an angle θ is formed between the ball-exiting tube 5 and the pick-up tube 30. In this embodiment, the angle θ is about 45°. The ball-exiting tube 5 has an open lower end and an open upper end that is communicated with the ball-exiting opening 37 in the pick-up tube 30. As such, the golf balls 7 (see FIG. 7) are movable from the pick-up tube 30 into the ball-exiting tube 5 via the ball-exiting opening 37 to thereby exit from the lower end of the ball-exiting tube 5.

The handle 6 is disposed movably on the pick-up tube 30, and extends upwardly from the upper end portion of the pick-up tube 30. The handle 6 has a rod body 62 extending through the upper end wall 35 of the pick-up tube 30, and a handgrip 62' sleeved fixedly on an upper end of the rod body 62. A ball-guiding unit includes a guide block 61 connected fixedly to a lower end of the handle 6 and having a top surface 611, a curved ball-guiding surface (or lower end surface) 612, an annular wall 613, and a blind hole 614 formed in the annular wall 613. The ball-guiding surface 612 has upper and lower ends 615, 616. A spring-biased pin 63 is disposed within the blind hole 614 in the guide block 61, and has a large-diameter inner pin portion 631 and a small-diameter outer pin portion 632. The pin 63 is biased by a coiled compression spring 633 such that the outer pin portion 632 projects from the blind hole 614 so as to engage a selected one of the upper and lower positioning holes 38, 39 in the pick-up tube 30. The pin 63 and the upper and lower positioning holes 38, 39 constitute a positioning unit.

When the golf ball pick-up device 3 is used, the handle 6 is disposed at an extended position shown in FIG. 4 whereat the upper end 615 of the ball-guiding surface 612 is aligned with a portion of the opening-defining wall 371 defining an upper end of the ball-exiting opening 37. In this state, the small-diameter outer portion 632 of the pin 63 engages the upper positioning hole 38 in the pick-up tube 30 so as to maintain the positioning of the handle 6 relative to the pick-up tube 30. When the golf ball pick-up device 3 is not used, the pin 63 is pressed to separate from the upper positioning hole 38. Subsequently, the handle 6 is moved downwardly within the pick-up tube 30 so as to bring the lower end 616 of the ball-guiding surface 612 into contact with the inward flange 44 of the sleeve member 40. As such, further downward movement of the handle 6 relative to the pick-up tube 30 is prevented. At this time, the handle 6 is rotated relative to the pick-up tube 30 until the small-diameter outer portion 632 of the pin 63 engages the lower positioning hole 39 in the pick-up tube 30 so as to maintain the positioning of the handle 6 relative to the pick-up tube 30 at a retracted position. Alternatively, a guide unit may be added to prevent rotation of the handle 6 relative to the pick-up tube 30.

Figure 6:
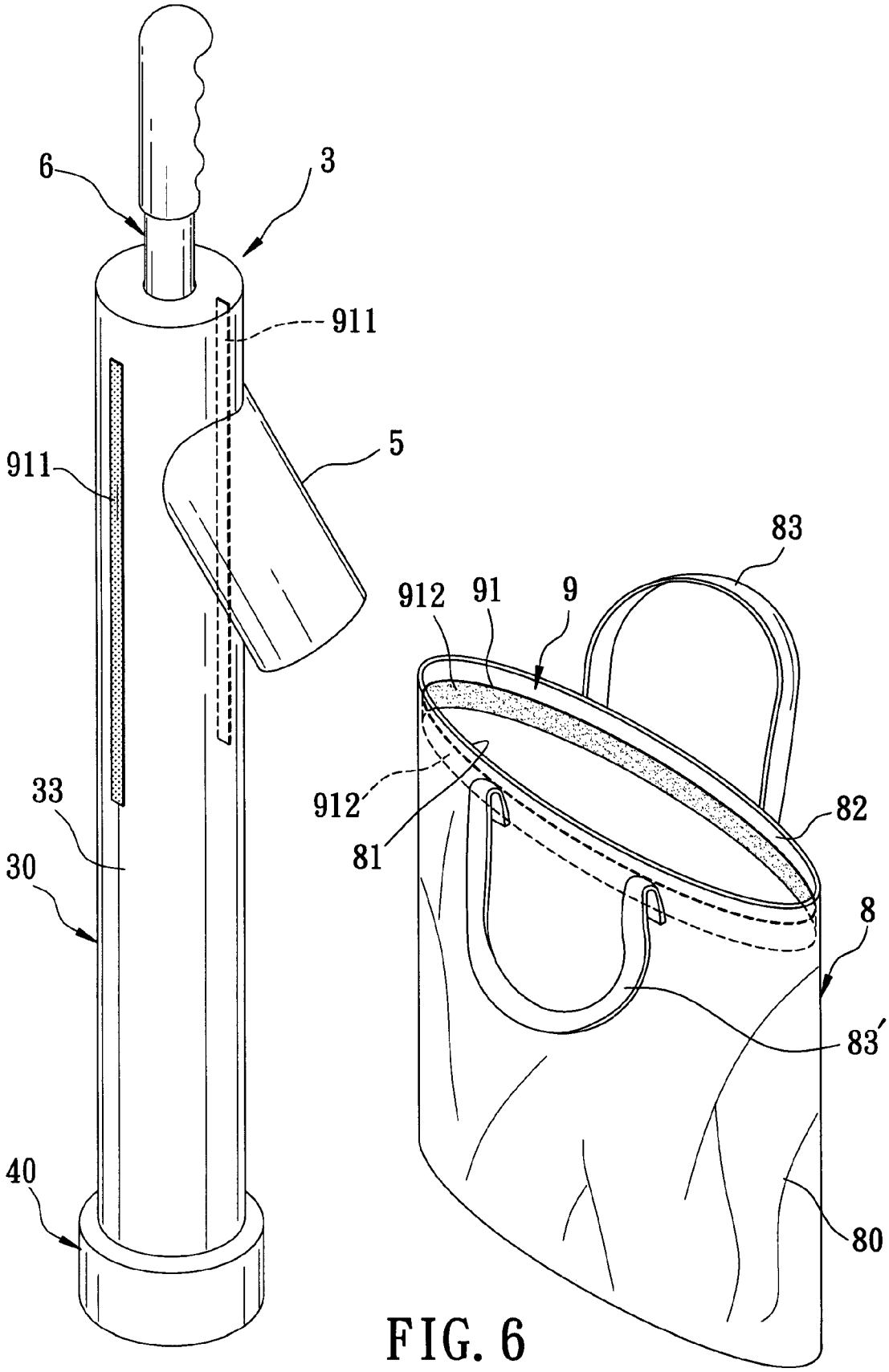
FIG. 6 is a partly exploded perspective view of the second preferred embodiment of a golf ball pick-up device according to this invention.
Figure 7:
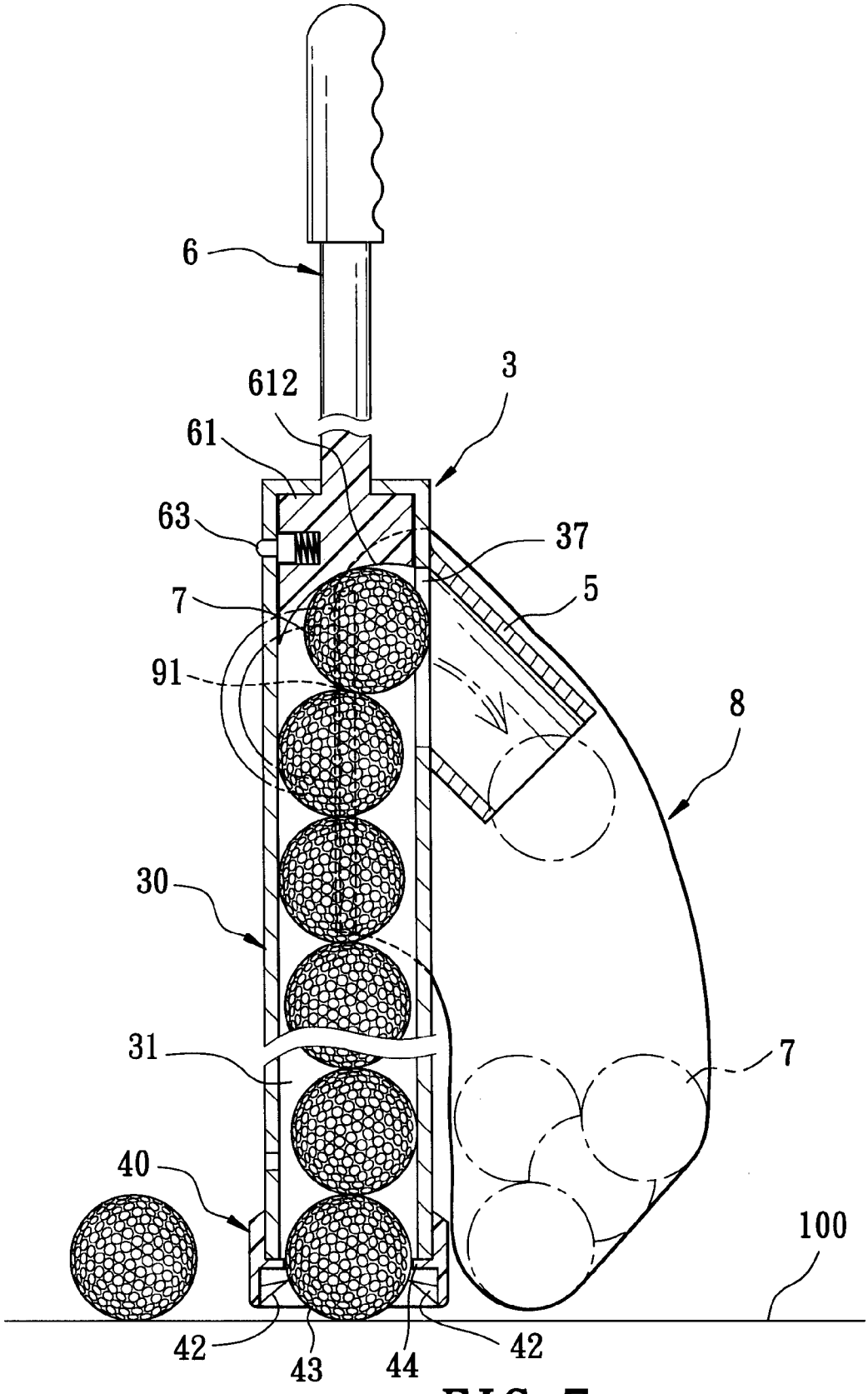
FIG. 7 is a schematic sectional view of the second preferred embodiment, illustrating how a plurality of golf balls are picked up.

FIGS. 6 and 7 show the second preferred embodiment of a golf ball pick-up device 3 according to this invention, which is similar in construction to the first preferred embodiment except for addition of a ball-collecting bag 8 and a bag-retaining unit 9. The ball-collecting bag 8 is sleeved on the ball-exiting tube 5 so as to receive the golf balls 7 falling from the lower end of the ball-exiting tube 5, and is connected removably to the ball-exiting tube 5 by the bag-retaining unit 9. The ball-collecting bag 8 includes a bag body 80 having an open upper end, and a pair of aligned first and second carrying straps 83, 83' each having two ends fastened to the open upper end of the bag body 80.

In this embodiment, the bag-retaining unit 9 includes two first hook-and-loop fasteners 911 and two second hook-and-loop fasteners 912. The first hook-and-loop fasteners 911 are attached respectively and fixedly to two opposite sides of an annular outer surface of the pick-up tube 30. The second hook-and-loop fasteners 912 are attached respectively and fixedly to two opposite sides 81, 82 of an inner surface of the ball-collecting bag 8, and engage respectively the first hook-and-loop fasteners 911.

Figure 8:
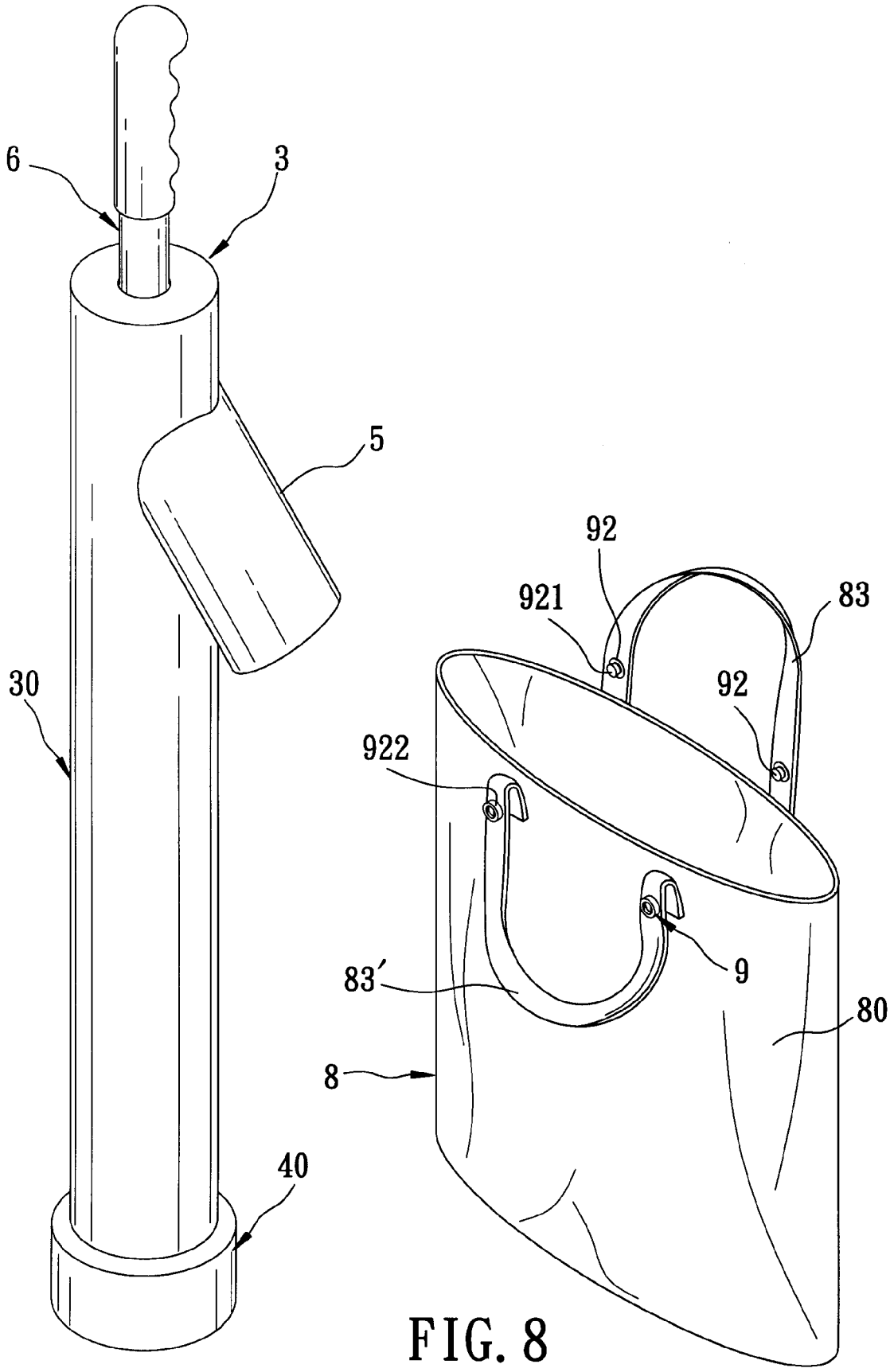
FIG. 8 is a partly exploded perspective view of the third preferred embodiment of a golf ball pick-up device according to this invention.
Figure 8A:
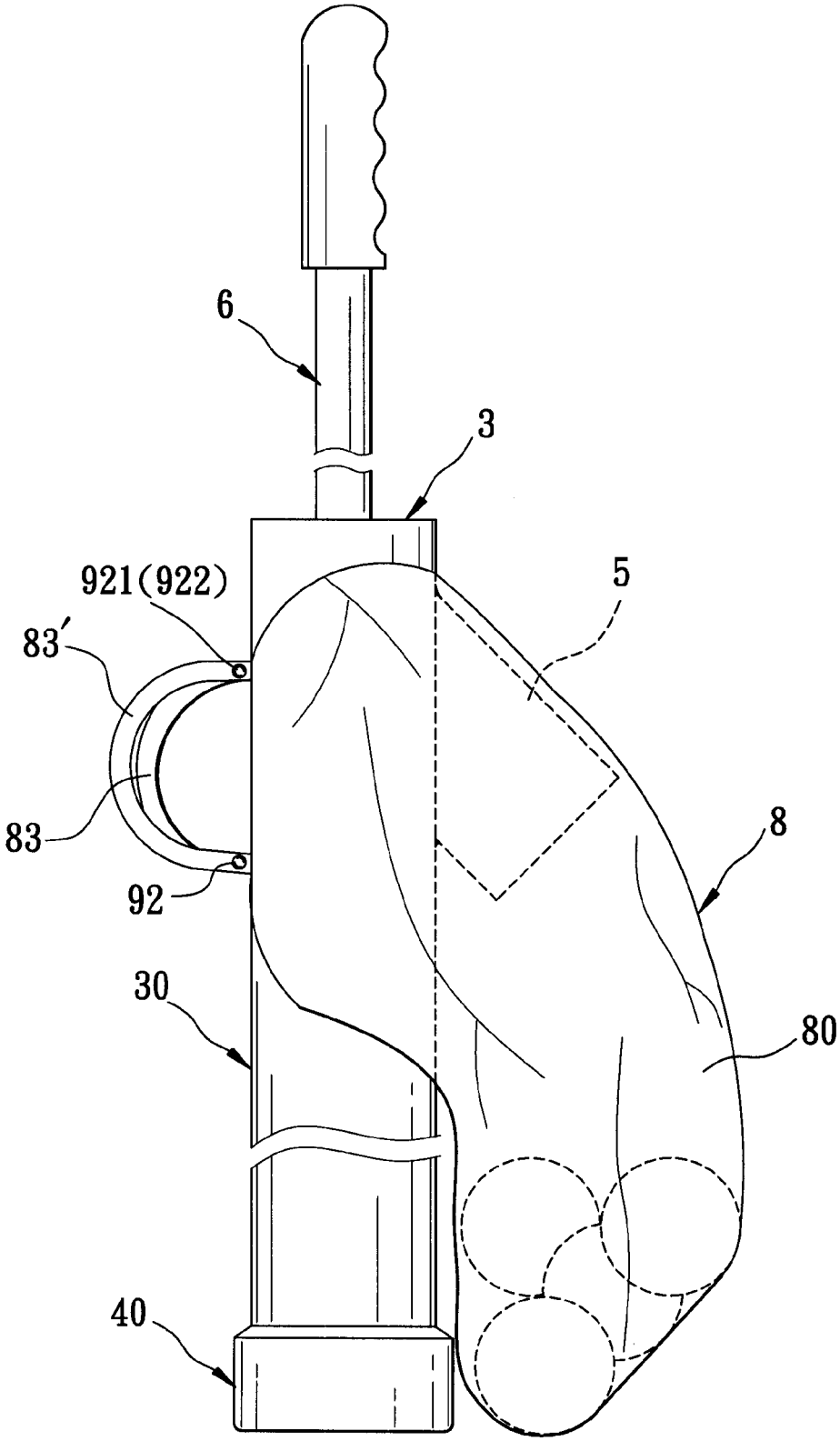
FIG. 8A is a schematic side view of the third preferred embodiment, illustrating how a plurality of golf balls are picked up.

FIGS. 8 and 8A show a modified bag-retaining unit 9, which is configured as two snap fastener units 92 and which includes two male snap fasteners 921 attached respectively and fixedly to the ends of the first carrying strap 83, and two female snap fasteners 922 attached respectively and fixedly to the ends of the second straps 83' and engaging respectively the male snap fasteners 921. The pick-up tube 30 is disposed between the bag body 80 and an assembly of the male and female snap fasteners 921, 922 so as to prevent removal of the ball-collecting bag 8 from the ball-exiting tube 5.

Figure 9:
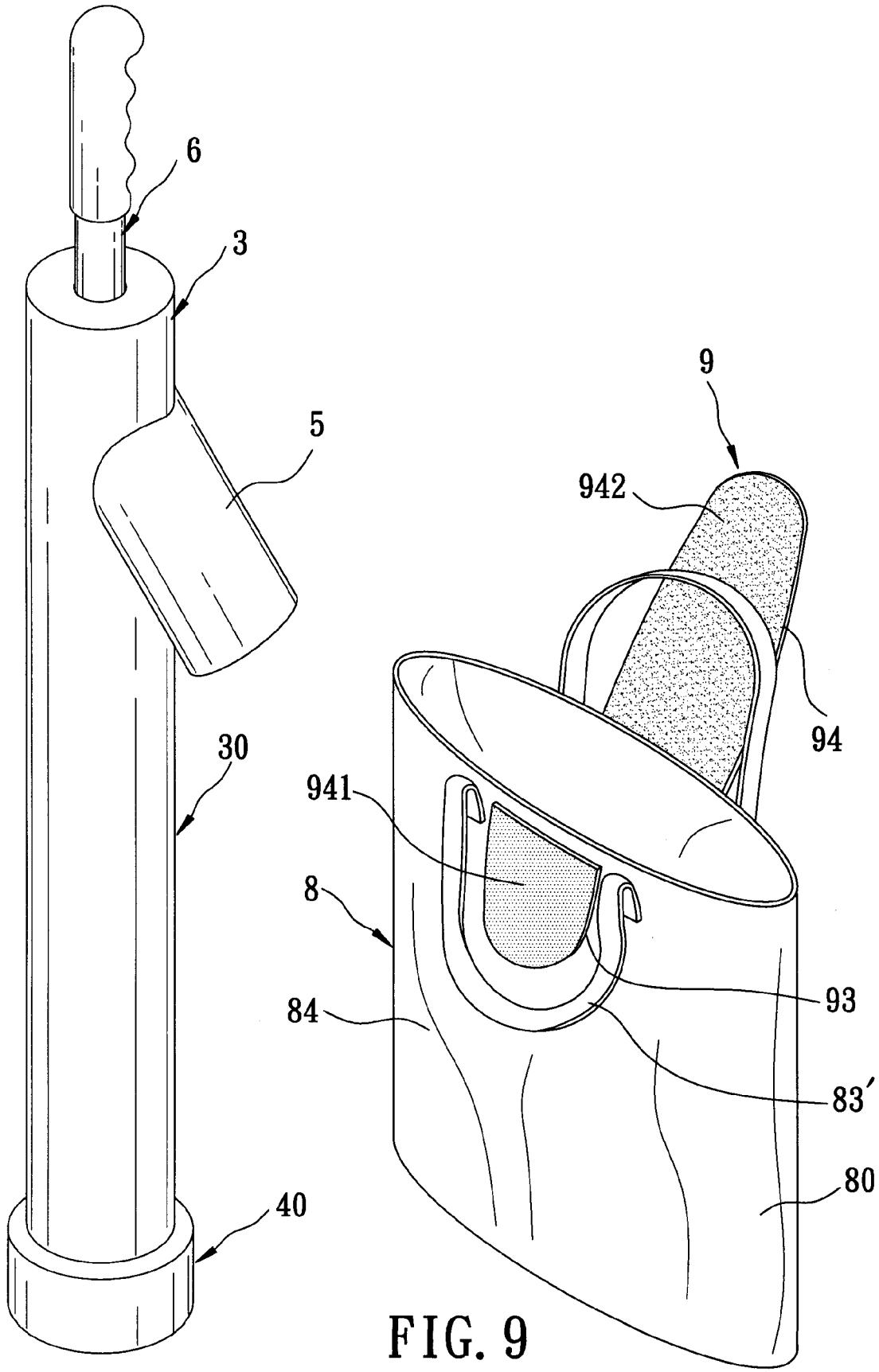
FIG. 9 is a partly exploded perspective view of the fourth preferred embodiment of a golf ball pick-up device according to this invention.
Figure 9A:
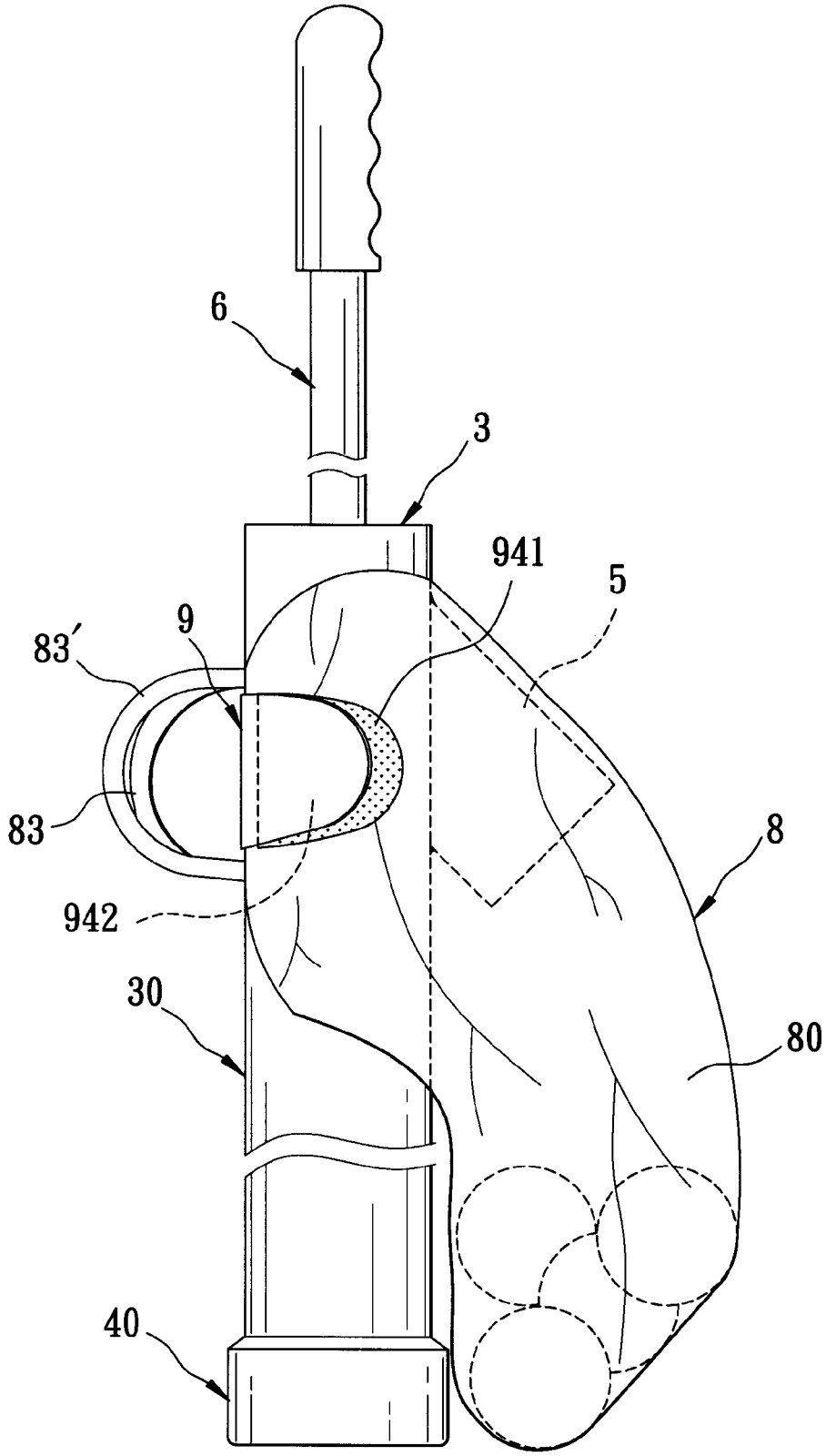
FIG. 9A is a schematic side view of the fourth preferred embodiment, illustrating how a plurality of golf balls are picked up.

FIGS. 9 and 9A show another modified bag-retaining unit 9, which includes a fixed plate 93 connected fixedly to a side of an outer surface of the ball-collecting bag 8, and a flexible tongue plate 94 having an end fastened to an opposite side of the outer surface of the ball-collecting bag 8 and extending upwardly from the open upper end of the bag body 80. The pick-up tube 30 is disposed between the bag body 80 and the tongue plate 94 so as to prevent removal of the ball-collecting bag 8 from the ball-exiting tube 5.

Referring to FIG. 7, when picking up the golf balls 7, since the golf ball pick-up device 3 is maintained in a generally vertical position, the golf balls 7 can be picked up without the need for the user to squat down, thereby resulting in convenient use. When the ball-receiving space 31 is filled with the golf balls 7, once an additional golf ball 7 enters into the pick-up tube 30 via the ball inlet 43, the uppermost golf ball 7 will automatically move into the ball-collecting bag 8 via the ball-exiting opening 37. This increases the ball pick-up efficiency since the user is not required to manually place the golf balls 7 in the ball-collecting bag 8.

Figure 10:
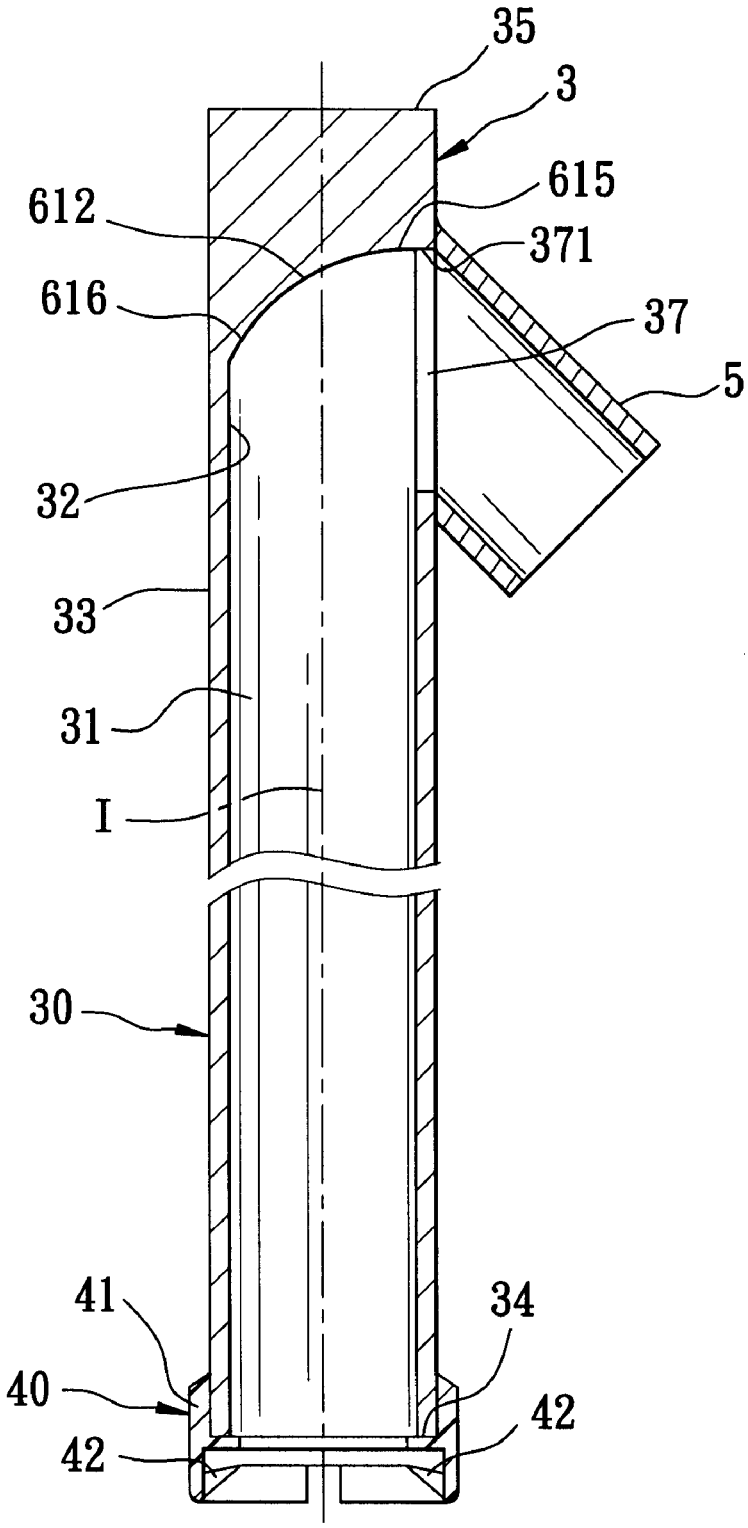
FIG. 10 is a sectional view of the fifth preferred embodiment of a golf ball pick-up device according to this invention.

FIG. 10 shows a modified ball-guiding unit that is formed integrally with the pick-up tube 30. That is, the pick-up tube 30 is formed with the ball-guiding surface 612.

With this invention thus explained, it is apparent that numerous modifications and variations can be made without departing from the scope and spirit of this invention. It is therefore intended that this invention be limited only as indicated by the appended claims.

I claim:

1. A golf ball pick-up device comprising:

an upright pick-up tube having an open lower end and an upper end portion that is formed with a ball-exiting opening;

a strip unit including a plurality of resilient strips each having a radial outer end connected fixedly to said lower end of said pick-up tube, said strips being arranged along a circumferential direction of said pick-up tube and extending radially and inwardly from said lower end of said pick-up tube so as to define a ball inlet thereamong, said strips deforming so as to allow a plurality of golf balls to move into said pick-up tube via said ball inlet when said strip unit is pressed against the golf balls one at a time, said strips being sized so as to prevent downward removal of the golf balls from said pick-up tube via said ball inlet; and a ball-guiding unit disposed within said upper end portion of said pick-up tube and formed with a ball-guiding surface shaped so as to guide the golf balls into said ball-exiting opening when the golf balls move upwardly within said upper end portion of said pick-up tube; and an upright handle disposed movably on said pick-up tube and extending upwardly from said upper end portion of said pick-up tube, and a positioning unit, said ball-guiding unit being connected fixedly to a lower end of said handle, said handle being disposed at an extended position whereat an upper end of said ball-guiding surface is adjacent to an upper end of said ball-exiting opening in said pick-up tube, and being movable to a retracted position whereat said ball-guiding surface is disposed within said lower end of said pick-up tube, said positioning unit positioning said handle in said extended position and said retracted position.

2. The golf ball pick-up device as claimed in claim 1, further comprising a sleeve member including a sleeve body sleeved fixedly on said open lower end of said pick-up tube, said resilient strips being formed integrally with a lower end of said sleeve body, said sleeve body being further formed with an inward flange extending radially and inwardly therefrom and abutting against said open lower end of said pick-up tube.

3. The golf ball pick-up device as claimed in claim 2, wherein said ball-guiding surface has a lower end abutting against said inward flange of said sleeve member when said handle is disposed in said retracted position.

4. The golf ball pick-up device as claimed in claim 1, wherein said pick-up tube is formed with upper and lower positioning holes, said ball-guiding unit including a guide block that is formed with said ball-guiding surface at a lower end thereof and that includes a spring-biased pin biased to engage a selected one of said upper and lower positioning holes in said pick-up tube, said pin and said upper and lower positioning holes constituting said positioning unit, said pin engaging said upper positioning hole when said handle is disposed in said extended position, said pin engaging said lower positioning hole when said handle is disposed in said retracted position.

5. The golf ball pick-up device as claimed in claim 4, wherein said pick-up tube has an upper end wall, said upper positioning hole in said pick-up tube being located such that said guide block comes into contact with said upper end wall of said pick-up tube when said handle is disposed in said extended position.

6. The golf ball pick-up device as claimed in claim 1, wherein said ball-exiting opening is defined by an opening-defining wall, said ball-guiding surface being curved, said upper end of said ball-guiding surface being aligned with a portion of said opening-defining wall that defines said upper end of said ball-exiting opening.

7. The golf ball pick-up device as claimed in claim 1, wherein said ball-guiding unit is formed integrally with said pick-up tube.

8. A golf ball pick-up device comprising:

an upright pick-up tube having an open lower end and an upper end portion that is formed with a ball-exiting opening;

a strip unit including a plurality of resilient strips each having a radial outer end connected fixedly to said lower end of said pick-up tube, said strips being arranged along a circumferential direction of said pick-up tube and extending radially and inwardly from said lower end of said pick-up tube so as to define a ball inlet thereamong, said strips deforming so as to allow a plurality of golf balls to move into said pick-up tube via said ball inlet when said strip unit is pressed against the golf balls one at a time, said strips being sized so as to prevent downward removal of the golf balls from said pick-up tube via said ball inlet;

a ball-guiding unit disposed within said upper end portion of said pick-up tube and formed with a ball-guiding surface shaped so as to guide the golf balls into said ball-exiting opening when the golf balls move upwardly within said upper end portion of said pick-up tube;

an inclined ball-exiting tube connected fixedly to and extending outwardly and downwardly from said pick-up tube, said ball-exiting tube having an open lower end and an upper end that is communicated with said ball-exiting opening in said pick-up tube such that the golf balls are movable from said pick-up tube into said ball-exiting tube via said ball-exiting opening to thereby exit from said lower end of said ball-exiting tube; and a ball-collecting bag sleeved on said ball-exiting tube so as to receive the golf balls falling from said lower end of said ball-exiting tube, and a bag-retaining unit for connecting said ball-collecting bag removably to said ball-exiting tube.

9. The golf ball pick-up device as claimed in claim 8, wherein said bag-retaining unit includes two first hook-and-loop fasteners attached respectively and fixedly to two opposite sides of an annular outer surface of said pick-up tube, and two second hook-and-loop fasteners attached respectively and fixedly to two opposite sides of an inner surface of said ball-collecting bag and engaging respectively said first hook-and-loop fasteners.

10. The golf ball pick-up device as claimed in claim 8, wherein said ball-collecting bag includes a bag body having an open upper end, and a pair of aligned first and second carrying straps each having two ends fastened to said open upper end of said bag body.

11. The golf ball pick-up device as claimed in claim 10, wherein said bag-retaining unit includes two male snap fasteners attached respectively and fixedly to said ends of said first carrying strap, and two female snap fasteners attached respectively and fixedly to said ends of said second carrying straps and engaging respectively said male snap fasteners, said pick-up tube being disposed between said bag body and an assembly of said male and female snap fasteners so as to prevent removal of said ball-collecting bag from said ball-exiting tube.

12. The golf ball pick-up device as claimed in claim 8, wherein said bag-retaining unit includes a fixed plate connected fixedly to a side of an outer surface of said ball-collecting bag, a flexible tongue plate having an end fastened to an opposite side of said outer surface of said ball-collecting bag and extending upwardly from said open upper end of said bag body, a first hook-and-loop fastener attached fixedly to said fixed plate, and a second hook-and-loop fastener attached fixedly to said flexible tongue plate and engaging said first hook-and-loop fastener, said pick-up tube being disposed between said bag body and said flexible tongue plate so as to prevent removal of said ball-collecting bag from said ball-exiting tube.

* * * * *